US005444627A

United States Patent [19]

Sandborg et al.

[11] Patent Number: 5,444,627

[45] Date of Patent: Aug. 22, 1995

[54] FUEL DELIVERY TEMPERATURE COMPENSATION SYSTEM AND METHOD OF OPERATING SAME

[75] Inventors: Thomas R. Sandborg, Washington; Prasad V. Parupalli, Peoria; Scott G. Sinn, Morton, all of Ill.

[73] Assignee: Caterpiller Inc., Peoria, Ill.

[21] Appl. No.: 133,531

[22] Filed: Oct. 6, 1993

[51] Int. Cl.[6] ..... F23N 5/00

[52] U.S. Cl. ..... 364/431.05; 364/431.12; 364/431.09; 364/431.01; 60/39.41; 60/602; 60/39.281; 123/478; 123/480; 123/357; 123/383; 123/514; 123/491

[58] Field of Search ..... 364/431.01–431.12, 364/569; 123/478, 480, 417, 381, 357, 352, 436, 435, 494, 383, 675, 486, 492, 493, 531, 390; 60/602, 276, 285, 28.281, 39.41; 417/292, 485

[56] References Cited

U.S. PATENT DOCUMENTS

| | | | |
|---|---|---|---|
| 3,689,200 | 9/1972 | Galis et al. | 417/292 |
| 3,768,368 | 10/1973 | Krauja et al. | 91/378 |
| 4,337,615 | 7/1982 | LaCroix | 60/39.141 |
| 4,502,437 | 3/1985 | Voss | 123/494 |
| 4,955,345 | 9/1990 | Brown et al. | 123/381 |
| 5,088,464 | 2/1992 | Meaney | 123/480 |
| 5,091,858 | 2/1992 | Paielli | 364/431.12 |
| 5,103,791 | 4/1992 | Tomisawa | 123/489 |
| 5,174,263 | 12/1992 | Meaney | 123/478 |
| 5,179,925 | 1/1993 | Orminski | 123/491 |
| 5,197,443 | 3/1993 | Hodgkins | 123/514 |
| 5,220,895 | 6/1993 | Curran et al. | 123/491 |
| 5,237,975 | 8/1993 | Betki et al. | 123/497 |
| 5,345,914 | 9/1994 | Tang | 123/478 |

*Primary Examiner*—Kevin J. Teska
*Assistant Examiner*—Jacques H. Louis-Jacques
*Attorney, Agent, or Firm*—R. Carl Wilbur

[57] ABSTRACT

An engine control is provided for compensating the fuel delivery to an internal combustion engine as a function of the energy content of the fuel. The engine control includes a fuel temperature sensor connected to an electronic controller. A memory device including a standard fuel delivery map stored therein is connected to the electronic controller. The electronic controller calculates a compensated fuel delivery map as a function of the standard fuel delivery map and the fuel temperature, and the controller issues a fuel delivery command based on the compensated fuel delivery map.

6 Claims, 1 Drawing Sheet

FUEL DELIVERY TEMPERATURE COMPENSATION SYSTEM AND METHOD OF OPERATING SAME

FIELD OF THE INVENTION

The present invention relates to engine controllers, and more particularly, to an engine controller that adjusts fuel delivery according to fuel temperature.

BACKGROUND OF THE INVENTION

Different types of electronic engine controllers are known in the art. Such controllers typically measure various engine parameters including engine speed, transmission output speed, and a desired engine speed command to produce a fuel delivery signal as a function of the measured parameters in connection with a fuel delivery map or a rack position map stored in memory.

In prior electronic engine controllers the fuel delivery signal causes the fuel injector (or rack position in an engine without fuel injectors) to inject a particular volume of fuel into a particular engine cylinder. The power produced by the volume of fuel depends on the energy content of the fuel, which varies with the density of the fuel. These prior art controllers cause a desired volume of fuel to be delivered to the individual engine cylinders. That volume will correspond to a desired energy content of the fuel so long as the fuel is at an appropriate density. However, because the fuel delivery map used by such controllers is calculated for a predetermined fuel density, it is difficult to precisely control the power produced by the engine when the density of the fuel varies from that predetermined density. In those cases, the delivered volume of fuel will produce more or less power than desired because of the increased or decreased energy content resulting from the decreased or increased density of the fuel, respectively.

It would be preferable to have an engine controller capable of delivering a compensated fuel delivery command that adjusts delivered fuel volume as a function of the density, and thus the energy content, of the fuel. The present invention is directed toward overcoming one or more of these drawbacks associated with previous electronic controllers.

SUMMARY OF THE INVENTION

In one aspect of the present invention, an engine controller is provided, wherein the engine controller includes a fuel temperature sensor, a microprocessor and a memory means. A standard fuel delivery curve is stored in memory. The microprocessor calculates a fuel delivery command in response to an engine parameter and a temperature of said fuel.

In another aspect of the invention, a method for generating an engine is disclosed including the steps of sensing a fuel temperature and calculating a compensated fuel delivery command in response to the sensed fuel temperature.

Other aspects and advantages of the present invention will become apparent upon reading the detailed description of the preferred embodiment in connection with the drawings and appended.

DETAILED DESCRIPTION OF A PREFERRED EMBODIMENT

Figure 1:
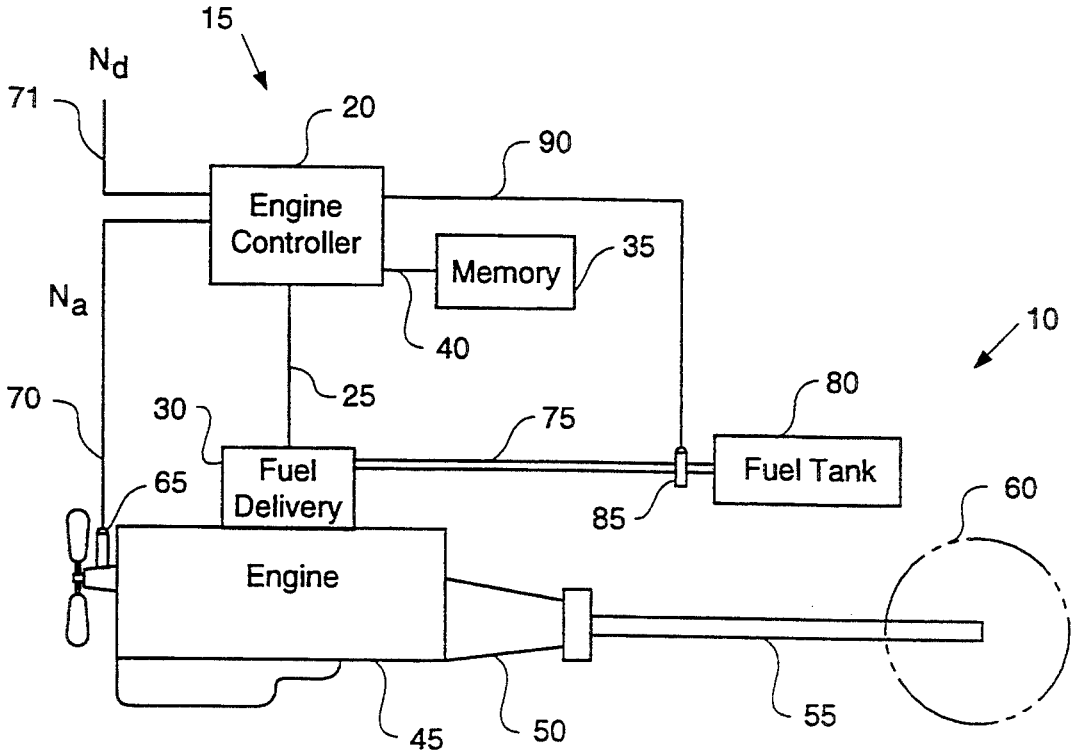
FIG. 1 illustrates in block diagram form a preferred embodiment of the engine controller of the present invention.

FIG. 1 illustrates, in block diagram form, the engine control 10 of the present invention. The engine control 10 will be described with reference to a vehicle engine and associated components. However, the present invention is not limited to use in connection with vehicle engines, but to the contrary, may be used in other engine applications.

The engine control includes an electronic engine controller 15. In a preferred embodiment, the electronic engine controller 15 includes a microprocessor 20. Numerous commercially available microprocessors can be adapted to perform the functions of the electronic engine controller 15 of the present invention. In a preferred embodiment the microprocessor 20 is a series MC68HC11 as manufactured by Motorola, Inc. of Schaumburg, Ill.

The microprocessor 20 is connected to a fuel delivery means 30 by an electrical conductor 25. The fuel delivery means 30 may include fuel injectors or a fuel rack. The fuel delivery means 30 delivers fuel to individual engine cylinders. As would be appreciated by those skilled in the art, the volume of fuel delivered to the engine cylinders is a function of a fuel delivery command received on the electrical conductor 25.

In a preferred embodiment, the fuel delivery means 30 includes fuel injectors (not shown) associated with each of the engine cylinders (not shown). As is known in the art, a solenoid is used in connection with each of the fuel injectors. Individual fuel delivery command signals are delivered to each of the solenoids to cause the solenoid to open and permit a specific volume of fuel to enter the engine cylinder. Such systems are well known in the art. One such system is disclosed is U.S. Pat. No. 5,197,867 entitled "Hydraulically-Actuated Electronically-Controlled Unit Injector Fuel System Having Variable Control of Actuating Fluid Pressure" which issued to Glassey on Mar. 9, 1993.

In a preferred embodiment, a discrete memory device 35 is connected to the microprocessor 20 by an electrical conductor 40. Although the preferred embodiment includes a discrete memory device 35, it should be readily apparent to those skilled in the art that suitable microprocessors exist that include memory means within the microprocessor. The present invention is not limited solely to controls using discrete memory, but instead encompasses the use of microprocessors having memory means included therein.

Stored within the memory device 35 is a standard fuel delivery map 210 (described below and illustrated graphically in FIG. 2). As is known to those skilled in the art, the microprocessor 20 monitors various engine parameter sensors including an engine speed sensor 65 and calculates a fuel delivery command that is issued to the individual fuel injectors based on a fuel delivery map and the values of those sensed engine parameters. Calculation of the fuel delivery command is discussed in more detail below.

An engine 45 is connected to a transmission 50 which transmits engine torque to a drive wheel 60 through a drive shaft 55 and associated gearing (not shown). Any suitable transmission control may be employed in connection with the present invention. Control of the transmission is not in itself part of the present invention, and is well known in the art. Thus, the transmission and transmission control will not be further described.

The microprocessor 20 is connected to the engine speed sensor 65. The engine speed sensor 65 is connected to the engine 45, and preferably is in the form of a magnetic pick-up sensor adapted to produce a signal corresponding to the rotational speed of the engine 45. One suitable sensor is described in U.S. Pat. No. 4,972,332 issued to Luebbering et al. on Nov. 20, 1990. However, many suitable engine speed sensors are known in the art, any one of which could be employed in connection with the present invention without departing from the scope of the invention as defined by the appended claims. The engine speed sensor 65 produces an actual engine speed signal $N_a$ that is an input to the microprocessor 20 over an electrical conductor 70.

Another input to the microprocessor 20 includes a desired engine speed command $N_d$ 71. The desired engine speed command can take several forms including an analogue signal whose voltage is proportional to the desired engine speed, or a pulse-width-modulated signal whose duty cycle is proportional to the desired engine speed. In a preferred embodiment, the desired engine speed command 71 is a pulse-width-modulated signal having a duty cycle that is proportional to the position of an accelerator pedal and is of the type generally disclosed in U.S. Pat. No. 4,915,075 issued to Brown.

Fuel is delivered to the fuel delivery means 30 through a fuel line 75. In the block diagram of FIG. 1, the fuel line 75 is directly connected to a fuel tank 80. However, as would be apparent to one skilled in the art, such systems generally include a fuel pump and other means for providing a pressurized supply of fuel at the fuel delivery means. One skilled in the art could readily and easily incorporate such features in connection with the present invention. Such fuel pumps and other devices are not in themselves part of the present invention and therefore are neither shown in the figures nor further described herein.

In a preferred embodiment, a temperature sensor 85 is installed in the fuel line 75, between the fuel tank 80 and the fuel delivery means 30. However, there are other suitable locations in which the temperature sensor could be installed without deviating from the scope of the present invention. For example, the temperature sensor 85 might be installed in the fuel tank 80 or within the fuel delivery means 30. Many temperature sensors are known in the art, any one of which is suitable for use in connection with the present invention. In a preferred embodiment of the invention, a thermistor is used. The use of a thermistor is well known in the art. One skilled in the art could readily and easily include a thermistor and associated circuity with the present invention to sense the temperature of the fuel.

The temperature sensor 85 produces a fuel temperature signal that is delivered to the microprocessor 20 over an electrical conductor 90. As is known to those skilled in the art, fuel density changes with the temperature of the fuel. As the temperature of the fuel increases, the fuel density decreases. Energy content of the fuel in turn depends on its density. Thus, more dense fuel contains more energy than an equal volume of less dense fuel. Because fuel density is a function of fuel temperature, the relative energy content of a volume of fuel can be determined as a function of the fuel temperature.

In a preferred embodiment, the microprocessor 20 calculates a standard fuel delivery command from the desired engine speed $N_d$ command 71, the actual engine speed signal $N_a$ 70, and a standard fuel delivery map 210. As shown in FIG. 2, a fuel delivery command is a function of a standard fuel delivery map 210 and the actual engine speed $N_a$ 70. Preferably, the controller regulates the actual engine speed using closed loop Proportional-Integral-Differential control ("PID control"). Such controls are known in the art. While a PID controller is the preferred control, other control strategies are well known and could be readily and easily adapted for use in connection with the present invention.

Closed loop engine controllers should ideally regulate the energy content of the fuel delivered to the engine cylinders in response to the difference between the actual and desired engine speeds. However, prior art closed loop controls instead deliver a volume of fuel as a function of the difference signal. Some prior art controllers include a volume limit on the amount of fuel that can normally be delivered to the engine. That limit is normally used when the operator commands near full engine power. The present invention is especially useful in those controllers. Because those controllers regulate the volume of fuel delivered to the engine as opposed to its energy content, and the energy content of fuel varies with temperature, those controllers may not cause enough fuel to be delivered when the fuel is warm, when the controller is commanding full power and the fuel delivery command is being limited by the volume limit. The electronic controller of the present invention permits the fuel delivery command to exceed the volume limit. The amount that the command exceeds the volume limit is a function of fuel temperature. The controller thereby compensates for the decreased energy content of the fuel, allowing the engine to attain maximum rated power.

The standard fuel delivery map 210 of the present invention calculates a standard fuel delivery command that is issued to a fuel injector to cause a desired volume of fuel to be injected into an engine cylinder. The standard fuel delivery map 210 is an empirically determined map that causes a certain volume of fuel, having a desired energy content, to be delivered to the engine. However, because the energy content of the fuel is calculated when the fuel is at a predetermined temperature, the energy content of that volume of fuel will,be approximately the desired energy content when the fuel temperature is approximately the same as the predetermined temperature. Because the energy content of fuel varies as the temperature of the fuel varies, the energy content of the commanded volume of fuel may be more or less than desired when the fuel temperature deviates from the predetermined temperature.

Figure 2:
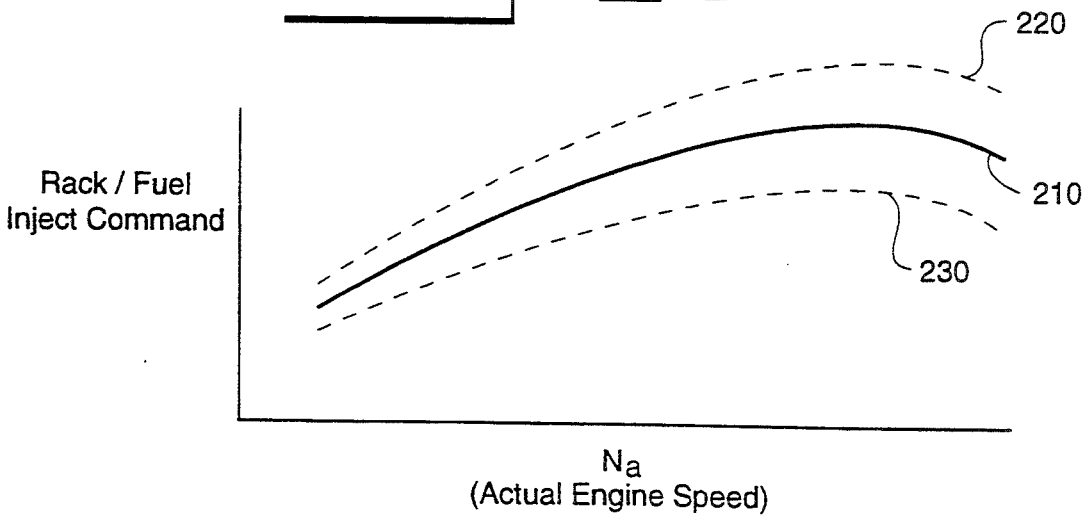
FIG. 2 graphically illustrates the fuel delivery adjustment of a preferred embodiment of the present invention.

Referring now to FIG. 2, the present invention modifies the standard fuel delivery command calculated from the standard fuel delivery map 210 as the fuel temperature varies from the predetermined fuel temperature. In a preferred embodiment, the predetermined fuel temperature is 40 degrees centigrade. An upper fuel delivery map 220 and a lower fuel delivery map 230 are provided. The upper fuel delivery map 230 represents an upper limit to a compensated fuel delivery command. Likewise, the lower fuel delivery map 210 represents a lower limit to a compensated fuel delivery command.

The compensated fuel delivery command adjusts the volume of fuel delivered to the engine as a function of both engine speed and fuel temperature. In a preferred embodiment of the invention, the compensated fuel delivery command is calculated according to the following formula:

$$\text{Compensated Fuel Delivery} = \text{Uncompensated Fuel Delivery} + \frac{1}{212} \cdot \frac{Na}{1000} \cdot (T_{fuel} - 40) \quad \text{EQN. 1}$$

where $T_{fuel}$=sensed temperature of the fuel in degrees centigrade.

Na=Engine Speed in RPM's.

The upper fuel delivery map 220 is calculated from EQN. 1 by substituting an upper temperature compensation limit for $T_{fuel}$. In a preferred embodiment, the upper temperature compensation limit is 90 degrees centigrade. Similarly, the lower fuel delivery map 230 is calculated from EQN. 1 by substituting a lower temperature compensation limit for $T_{fuel}$. In a preferred embodiment, the lower temperature compensation limit is −40 degrees centigrade. Although these temperature values are used in the preferred embodiment, those skilled in the art could readily and easily modify these values or the above formula without deviating from the scope of the present invention as defined in the appended claims.

FIG. 2 generally illustrates the relationship between the standard fuel delivery map 200, the upper fuel delivery map 210, and the lower fuel delivery map 220. These maps are exemplary of the fuel delivery maps that are used in connection with the present invention. Because each individual engine application may have different fuel delivery requirements, one set of fuel delivery maps cannot be shown for all engine applications. However, one skilled in the art could readily and easily implement the compensation feature of the present invention once a standard fuel delivery map for a specific engine application is known.

Using EQN. 1 and the fuel delivery maps of FIG. 2, the microprocessor 20 then measures the actual fuel temperature as sensed by the fuel temperature sensor 85. If the actual fuel temperature exceeds the predetermined fuel temperature then a compensated fuel delivery map is calculated according to EQN. 1, with the upper fuel delivery map 220 acting as an upper limit to the compensated fuel delivery map. As noted above, in a preferred embodiment the upper fuel delivery map 220 is calculated by substituting the upper temperature compensation limit into EQN 1. If the temperature of the fuel exceeds the upper temperature compensation limit, then the compensated fuel delivery map will substantially equal the upper fuel delivery map 220.

Likewise, if the actual fuel temperature is less than the predetermined fuel temperature then a compensated fuel delivery map will be calculated according to EQN. 1, with the lower fuel delivery map 230 forming a lower limit for the compensated fuel delivery map. As noted above, in a preferred embodiment the lower fuel delivery map 230 is calculated by substituting the lower temperature compensation limit into EQN 1. If the actual fuel temperature is below the lower temperature compensation limit, then the fuel delivery map will substantially equal the lower fuel delivery map 230.

When the fuel temperature is between the upper and lower temperature compensation limits, the microprocessor 20 calculates the compensated fuel delivery map according to EQN. 1.

By compensating the fuel delivery command in the foregoing manner, the present invention calculates a fuel delivery command that is a function of energy content of the injected fuel. As the temperature of the fuel increases, and therefore the density decreases, the energy content of a unit volume of fuel decrease. The engine controller of the present invention calculates a compensated fuel delivery map that increases the volume of fuel to be delivered to the engine in such a situation to compensate for the reduced energy content of the warmer fuel. Likewise, when the temperature of the fuel decreases, its density increases and the energy content of a unit volume of fuel increases. The engine controller of the present invention calculates a compensated fuel delivery map that decreases the volume of fuel delivered to the engine to compensate for the increased energy content of fuel. In this manner the fuel command is a function of the energy content of the fuel as opposed to being solely a function of the volume of injected fuel.

We claim:

1. An engine controller for use with an engine, comprising:

fuel delivery means for delivering fuel to an engine cylinder in response to receiving a fuel delivery command;

an engine speed sensor;

a fuel temperature sensor;

a memory device, said memory device including a standard fuel delivery map;

an electronic controller connected to said engine speed sensor, said fuel temperature sensor, and said memory device;

an upper fuel delivery map stored in memory;

an upper compensation temperature limit;

wherein said electronic controller calculates a fuel delivery command in response to the sensed values of said engine speed sensor and said fuel temperature sensor;

wherein said fuel delivery command is delivered to said fuel delivery means;

wherein said electronic controller calculates a compensated fuel delivery map as a function of said standard fuel delivery map and said sensed value of said fuel temperature sensor; and wherein said compensated fuel delivery map is substantially equal to said upper fuel delivery map in response to a sensed value of said fuel temperature exceeding said upper temperature compensation limit.

2. The engine controller according to claim 1, including:

a lower fuel delivery map stored in memory;

a lower compensation temperature limit; and wherein said compensated fuel delivery map is substantially equal to said lower fuel delivery map in response to a sensed value of said fuel temperature being less than said lower temperature compensation limit.

3. The engine controller according to claim 2 wherein said compensated fuel delivery map is between said upper and lower fuel delivery map in response to said fuel temperature being between said upper and lower compensation temperature limits.

4. An engine controller for use with an engine, comprising:

fuel delivery means for delivering fuel to an engine cylinder in response to receiving a fuel delivery command;

an engine speed sensor;

a fuel temperature sensor;

a memory device, said memory device including a standard fuel delivery map;

an electronic controller connected to said engine speed sensor, said fuel temperature sensor, and said memory device;

a lower fuel delivery map stored in memory;

a lower compensation temperature limit;

wherein said electronic controller calculates a fuel delivery command in response to the sensed values of said engine speed sensor and said fuel temperature sensor;

wherein said fuel delivery command is delivered to said fuel delivery means;

wherein said electronic controller calculates a compensated fuel delivery map as a function of said standard fuel delivery map and said sensed value of said fuel temperature sensor; and wherein said compensated fuel delivery map is substantially equal to said lower fuel delivery map in response to a sensed value of said fuel temperature being less than said lower temperature compensation limit.

5. A method of operating an internal combustion engine having a fuel delivery means for delivering fuel to individual engine cylinders and an electronic controller that calculates a fuel delivery command as a function of sensed engine operating parameters and a standard fuel delivery map, wherein said fuel delivery command is issued to said fuel delivery means, and wherein said fuel delivery means is connected to a fuel supply, comprising the steps of:

sensing a temperature of fuel being delivered by said fuel delivery means;

comparing the temperature of the fuel to a predetermined fuel temperature;

computing a compensated fuel delivery map;

issuing a fuel delivery command as a function of said engine operating parameters and said compensated fuel delivery map;

reducing said standard fuel delivery map in response to said fuel temperature being less than said predetermined temperature; and increasing said standard fuel delivery map in response to said fuel temperature being greater than said fuel delivery map.

6. The method as set forth in claim 5, including the step of:

comparing said fuel temperature to an upper temperature compensation limit;

comparing said fuel temperature to a lower temperature compensation limit;

wherein said compensated fuel delivery map is substantially equal to an upper fuel delivery map in response to said fuel temperature exceeding said upper temperature compensation limit; and wherein said compensated fuel delivery map is substantially equal to said lower fuel delivery map is response to said fuel temperature being below said lower temperature compensation limit.

* * * * *